US005211675A

United States Patent [19]

Bardey et al.

[11] Patent Number: 5,211,675

[45] Date of Patent: May 18, 1993

[54] VARIABLE VOLUME COMBUSTION CHAMBER FOR A GAS TURBINE ENGINE

[75] Inventors: Xavier M. H. Bardey, Chartrettes; Michel A. A. Desaulty, Vert Saint Denis; Serge M. Meunier, Le Chatelet En Brie, all of France

[73] Assignee: Societe Nationale d'Etude et de Construction de Moteurs d'Aviation, France

[21] Appl. No.: 822,754

[22] Filed: Jan. 21, 1992

[30] Foreign Application Priority Data

Jan. 23, 1991 [FR] France ..... 91 00723

[51] Int. Cl.[5] ..... F23R 3/44

[52] U.S. Cl. ..... 60/39.2; 60/752

[58] Field of Search ..... 60/752, 757, 39.23, 60/39.2

[56] References Cited

U.S. PATENT DOCUMENTS

| | | | |
|---|---|---|---|
| 2,655,787 | 10/1953 | Brown | 60/39.23 |
| 3,183,664 | 5/1975 | Divone . | |
| 3,916,621 | 11/1975 | Amenta | 60/262 |
| 4,150,539 | 4/1979 | Rubins et al. | 60/39.23 |
| 4,179,879 | 12/1979 | Kincaid, Jr. | 60/39.63 |
| 4,199,934 | 4/1980 | Meyer | 60/39.23 |
| 5,125,227 | 6/1992 | Ford et al. | 60/39.23 |

FOREIGN PATENT DOCUMENTS

| | | |
|---|---|---|
| 2065688 | 8/1971 | France . |
| 700004 | 11/1953 | United Kingdom . |

*Primary Examiner*—Timothy S. Thorpe
*Attorney, Agent, or Firm*—Bacon & Thomas

[57] ABSTRACT

A variable volume combustion chamber for a gas turbine engine that has a movable wall to vary the volume of the combustion chamber. The movable wall is positioned according to the operating conditions of the gas turbine engine, achieving one extreme position under idle power and another extreme position under full power. The movement of the wall between the two extreme positions maximizes the efficiency of the combustion chamber for operating conditions between idle and full power. The combustion chamber also restricts at least a portion of the oxidizer intake when the movable wall is positioned for idle power conditions and opens the oxidizer intake when the wall is positioned for maximum power conditions to maximize the flow of oxidizer into the combustion chamber.

9 Claims, 3 Drawing Sheets

VARIABLE VOLUME COMBUSTION CHAMBER FOR A GAS TURBINE ENGINE

BACKGROUND OF THE INVENTION

Presently, gas turbine engine combustion chambers are difficult to design because of the different modes of operation of the gas turbine engine. The combustion chamber cannot provide for the optimum operating parameters at both idle power and full power, since the parameters for these extremities of operation are often contradictory. In practice, therefore, combustion chambers have been designed as a compromise between the desired ideal shape and volume required by the idle power requirements and the full power requirements.

A substantial problem in combustion chamber design is to provide the satisfactory richness of the fuel/oxidizer mixture. Experiments have been conducted toward reducing the flow of oxidizer (generally air) fed into the combustion chamber when the gas turbine engine is operating under idle conditions and to increase the oxidizer intake flow under full power conditions.

French Patent No. 2,065,688 describes a system which partially alleviates this oxidizer flow problem, but does not completely solve the problem for the desired full range of engine operation.

SUMMARY OF THE INVENTION

The present invention relates to a variable volume combustion chamber for a gas turbine engine that has a movable wall to vary the volume of the combustion chamber. The movable wall is positioned according to the operating conditions of the gas turbine engine, achieving one extreme position under idle power and another extreme position under full power. The movement of the wall between the two extreme positions maximizes the efficiency of the combustion chamber for operating conditions between idle and full power.

The combustion chamber according to the present invention also restricts at least a portion of the oxidizer intake when the movable wall is positioned for idle power conditions and opens the oxidizer intake when the wall is positioned for maximum power conditions to maximize the flow of oxidizer into the combustion chamber.

A control cylinder having an extendible and retractable piston rod is connected to the movable wall in order to move it between its extreme positions. The oxidizer intake orifice may be blocked by a shutter attached to the movable wall to minimize the flow of oxidizer into the combustion chamber under idle conditions. As the control cylinder moves the wall toward its other extreme position, the shutter moves away from the oxidizer intake orifice to uncover the orifice and allow a greater amount of oxidizer to flow into the combustion chamber.

A downstream, exit portion of the combustion chamber, through which the combustion gases pass, provides a device to allow the wall to move between its extreme position, while preventing leakage of the exhaust gases. This is accomplished by a telescoping collar segment portion wherein the collar segments telescopically move with respect to each other as the movable wall moves between its extreme positions. The collar segments may be formed from a rigid material and may define a plurality of cooling holes to establish, in known fashion, a film of cooling air along the inner surface of the exit portion of the combustion chamber. One of the collar segments, which extends the furtherest in a downstream direction, is attached to a fixed housing which encloses the combustion chamber. The collar segment extending the furtherest in the upstream direction is either attached to, or formed as part of, the movable wall.

The foremost advantage of the combustion chamber according to the present invention is that it achieves optimum combustion conditions for all ranges of operation of the gas turbine engine, from idle power settings through full power settings. The optimization of the combustion conditions reduces the pollution caused by the exhaust gases throughout the full range of operation of the engine. In particular, it is possible to reduce the carbon oxides and unburned substances in the exhaust gases under idle or low power conditions, while at the same time, reducing the nitrogen oxides and unburned substances in the exhaust gases under full power conditions.

DETAILED DESCRIPTION OF THE PREFERRED EMBODIMENT

Figure 1:
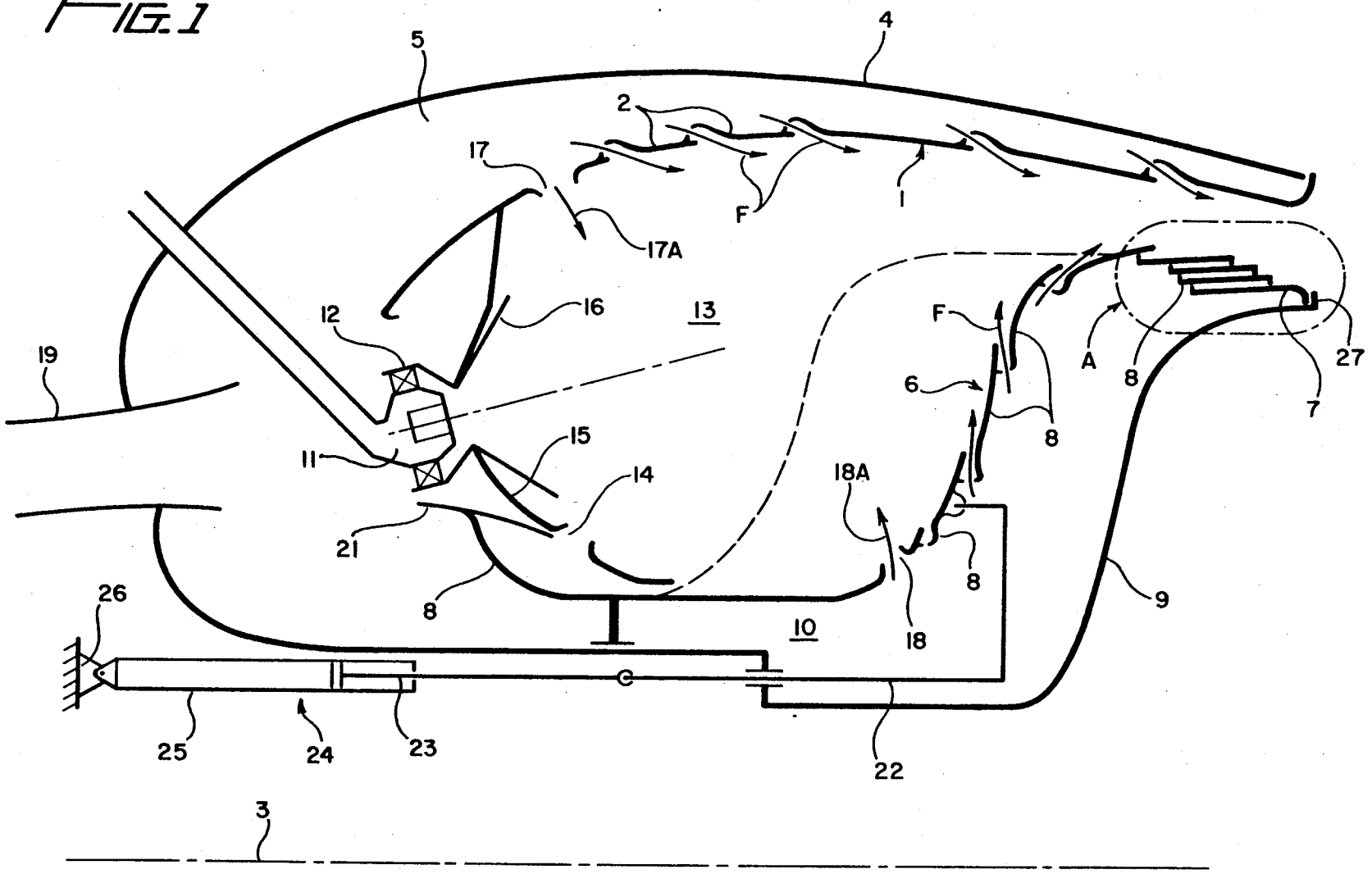
FIG. 1 is a partial, axial cross sectional view of the combustion chamber according to the present invention with the movable wall in a first extreme position.

The variable volume combustion chamber according to this invention will be described in conjunction with an annular combustion chamber extending about an axis. However, it is to be understood that the principles disclosed herein are equally applicable to any combustion chamber.

The combustion chamber has a first, fixed, outer wall 1 which, in known fashion, may be formed from a plurality of collars 2 which form surfaces of revolution about axis 3. An outer wall of a housing 4 defines space 5 with the fixed wall 1.

An inner, movable wall 6 defines the combustion chamber 13 with fixed outer wall 1. Movable inner wall 6 also may be formed, in known fashion, from an assembly of collars. These collars, which are also surfaces of revolution about axis 3 may comprise a collar segment 7 which is fixedly attached to an inner wall 9 of the housing which encloses the combustion chamber structure. The other portions of the movable wall 6 are all movable relative to the fixed wall 1 and with respect to the fixed collar segment 7. The movable inner wall 6 and the inner wall 9 of the housing define a space 10 therebetween, which communicates freely with the space 5.

A fuel injector 11 communicates with an upstream portion of the fixed wall 1 and, in known fashion, injects fuel into the combustion chamber 13. A primary oxidizer air intake 12 surrounds the fuel injector nozzle 11, again in known fashion, and directs primary air into the combustion chamber.

Dilution and/or additional primary intake air may pass into the combustion chamber through a first intake orifice 14 and/or a second intake orifice 17, both of which are defined by the fixed wall 1. A third dilution and/or primary intake air orifice 18 is defined by the movable wall 6. Intake air moves through the intake orifices 17 and 18 in the direction of arrows 17A and 18A, as illustrated in FIG. 1.

As also illustrated in FIG. 1, shutter 21, fixedly attached to portion 8 of movable wall 6 prevents communication of the spaces 5 and 10 with the air intake orifice 14. This minimizes the dilution/primary air intake into the combustion chamber by restricting or closing off the intake orifice 14. Shutter 21 cooperates with the structure 15, formed as part of the stationary wall 1, to restrict the intake air through intake orifice 14.

A conduit 19 which communicates with a known air compressor (not shown) directs the compressed intake air into spaces 5 and 10 within the housing walls 4 and 9.

Figure 2:
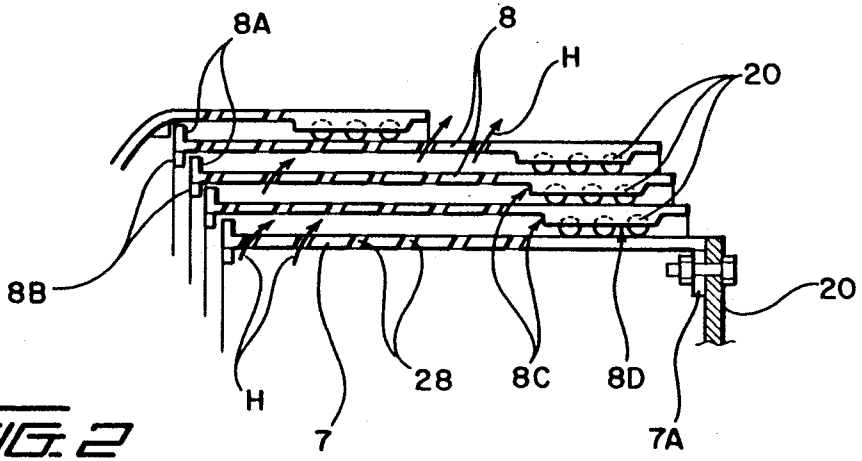
FIG. 2 is a partial, cross sectional, enlarged view of the detail A shown in FIG. 1.

The downstream portion of the movable wall 6, denoted by detail A in FIG. 1, is illustrated in more detail in FIG. 2. As can be seen, the movable collars 8 of the movable wall 6 have stops 8A and 8B located at their upstream portions and have stops 8C located at their downstream portions. The stops 8A located on the upper, or radially outermost surfaces, of the collar segments 8 is located between the stops 8B and 8C located on the radially inner surface of an adjacent collar segment 8, such that the telescopic movement of the collars are limited in their travel relative to each other. Translational slide means are interposed between adjacent collar segments to minimize the friction between the collars as they move relative to each other. In the embodiment shown, this slide means may comprise rollers or balls 20 located in section 8D of each collar segment 8. As an alternative, the surfaces of section 8D may be coated or otherwise treated with a low-friction material to act as a reduced friction slide means. The collar segments may be treated with aluminum or a similar material.

The collars 2 of the fixed wall 1 define, in known fashion, orifices extending through a ribbed portion to allow communication between the space 5 and the interior of the combustion chamber 13. These orifices allow the intake air to form a cooling film along the inner surface of the wall 1, the surface facing the interior of the combustion chamber 13. The air passing through the orifices is denoted by arrows F.

The movable wall 6, at its upstream portion nearest the inlet conduit 19, has a shutter 21 mounted thereon. In the position of the movable wall 6 illustrated in FIG. 1, for operation under idle power conditions, it can be seen that the shutter 21 restricts or cuts off the intake air flow through the orifice 14 by its cooperation with structure 15 and directs this air into the space 10.

The movable wall 6 is connected to an actuating means 24 by a linkage 22. The actuating means 24 may comprise a power cylinder 25 having a retractable and extendible piston rod 23 which is connected to linkage 22. The movement of piston rod 23 in cylinder 25 is generally parallel to the axis 3. Such movement of the piston rod 23 causes linear movement of the movable wall 6 relative to the fixed wall 1 along a path that is also generally parallel to the axis 3. Power cylinder 25 may be fixedly attached to a stationary structure 26 such that it remains stationary relative to the housing defined by walls 4 and 9.

The downstream collar segment 7 is attached at 7A to a flange 27 extending from the downstream portion of inner housing wall 9.

Figure 4:
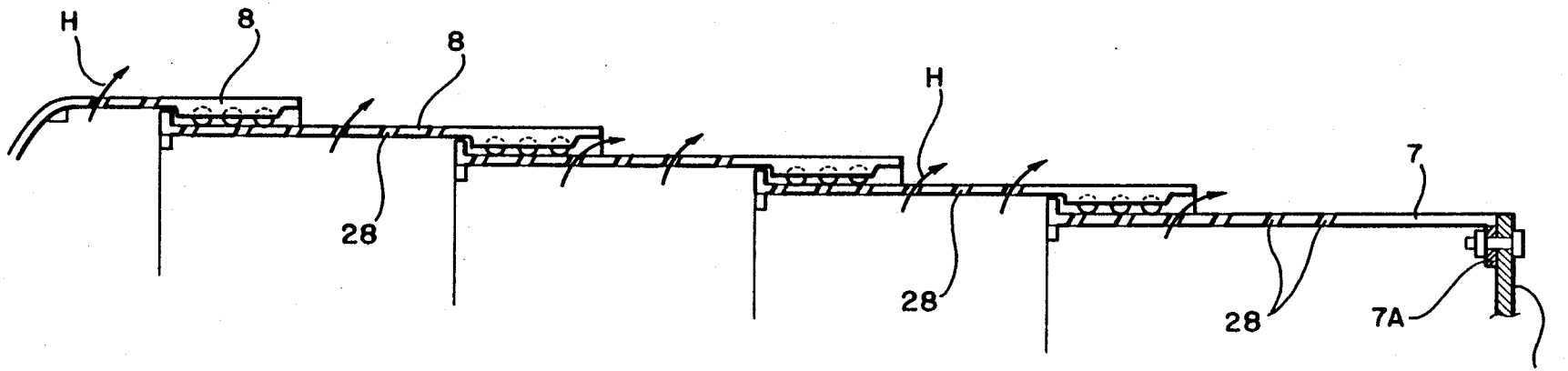
FIG. 4 is a partial, enlarged, cross sectional view similar to FIG. 2, but showing the detail of the collar segment indicated at B in FIG. 3.

Each of the collar segments 7 and 8 may define a plurality of holes 28 to allow the oxidizer air present in space 10 to pass through each of the collar segments in the direction of arrows H in FIG. 4, to form a cooling film on the interior surfaces of the collar segments to cool them against the hot exhaust gases passing through the downstream exhaust exit.

Figure 3:
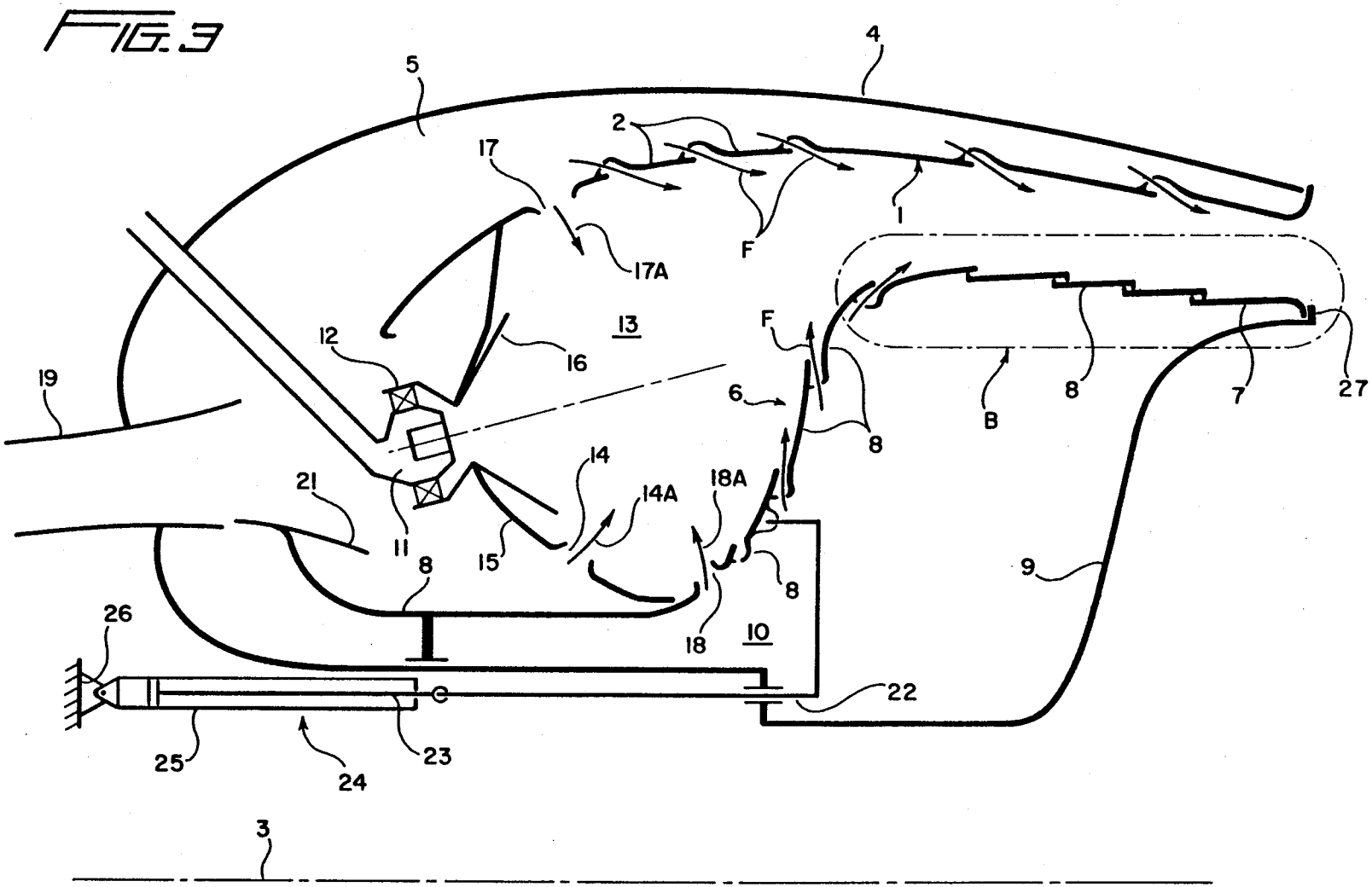
FIG. 3 is a cross sectional view similar to FIG. 1, but illustrating the movable wall in its second extreme position.

The two extreme positions of the movable wall 6 are illustrated in FIGS. 1 and 3. The position of a portion of the inner wall 6 corresponding to FIG. 3 is illustrated in dashed lines in FIG. 1. As illustrated in FIG. 3, the piston rod 23 has been fully retracted into power cylinder 25, thus moving the inner wall 6 to its second, extreme position corresponding to engine operation at the full power setting. Such movement of the inner wall 6 also causes displacement of the shutter 21 away from structure 15, thereby uncovering oxidizer air intake orifice 14. Shutter 21 may be moved adjacent to the end of intake conduit 19 such that it directs a portion of the incoming oxidizer air toward structure 15 and, consequently, orifice intake 14. The dilution/primary oxidizer passes through intake orifice 14 in the direction of arrow 14A, shown in FIG. 3.

A comparison of FIGS. 1 and 3 clearly indicates that movement of the inner wall 6 will vary the total volume of the combustion chamber 13, such volume being reduced when the gas turbine engine is operating at a full power setting.

Under idle operating conditions, it is necessary to reduce the oxidizer flow into the combustion chamber. This is accomplished by shutter 21 suppressing the communication between the intake orifice 14 and the inlet conduit 19. Accordingly, the temperature of the combustion chamber is raised, thereby increasing the reaction rates and making the combustion more efficient and stable. With the volume of the combustion chamber at its maximum, optimum combustion conditions are achieved such that the exhaust gases produce only small amounts of carbon oxides and unburned substances.

Under full power operation, as illustrated in FIG. 3, the volume of the combustion chamber 13 is at a minimum resulting in reduced dwell time of the gases inside the combustion chamber. This minimizes the production of fumes and nitrogen oxides in the exhaust gases. The required amount of oxidizer passing into the combustion chamber 13 is achieved by the uncovering of orifice 14 by shutter 21.

For the two extreme positions, as well as all intermediate positions, the movable wall 6 provides a continuous transition between its extreme positions, thereby providing stable operation and low pollution for all operating conditions.

The foregoing description is provided for illustrative purposes only, and should not be construed as in any way limiting this invention, the scope of which is defined solely by the appended claims.

We claim:

1. A variable combustion chamber having an exit end for a gas turbine engine operable between idle and full power settings comprising:

a) a first, fixed wall defining at least one intake orifice adapted to allow an oxidizer to pass into the combustion chamber;

b) a movable second wall located such that the first and second walls bound the combustion chamber;

c) means to move the second wall relative to the first wall between a first position in which the volume of the combustion chamber is at a maximum when the gas turbine engine operates at an idle power setting and a second position in which the volume of the combustion chamber is at a minimum when the gas turbine operates at a full power setting;

d) a shutter operatively associated with the second, movable wall such that it moves with the second wall between a first shutter position wherein the shutter at least partially blocks the at least one intake orifice so as to restrict the passage of oxidizer therethrough, and a second shutter position wherein the at least one intake orifice is unobstructed; and, e) a plurality of relatively movable, telescoping collar segments operatively associated with the second wall and located adjacent to the exit end of the combustion chamber.

2. The variable volume combustion chamber of claim 1 further comprising stop means located between the relatively movable telescoping collar segments so as to limit the amount of relative movement between adjacent collar segments.

3. The variable volume combustion chamber of claim 2 further comprising a fixed housing substantially enclosing the first and second walls and means to attach a collar segment to the fixed housing.

4. The variable volume combustion chamber of claim 2 further comprising anti-friction means operatively interposed between adjacent relatively movable collar segments.

5. The variable volume combustion chamber of claim 4 wherein the anti-friction means comprises rollers.

6. The variable volume combustion chamber of claim 4 wherein the anti-friction means comprises balls.

7. The variable volume combustion chamber of claim 1 wherein each telescoping collar segment defines a plurality of holes to allow the passage of cooling air therethrough.

8. The variable volume combustion chamber of claim 1 wherein the first and second walls define a substantially annular combustion chamber extending about an axis, and wherein the means to move the second wall moves the second wall along a substantially linear path of travel generally parallel to the axis.

9. The variable volume combustion chamber of claim 1 wherein the means to move the second wall comprises:

a) power cylinder means having an extendible and retractable piston rod; and, b) linkage means operatively connecting the piston rod and the second wall.

* * * * *